US006202887B1

(12) United States Patent
Petit

(10) Patent No.: US 6,202,887 B1
(45) Date of Patent: Mar. 20, 2001

(54) CASE WITH SEALED CLOSURE

(75) Inventor: Robert Petit, Chevilly Larue (FR)

(73) Assignee: Lir France, Chevilly Larue (FR)

( * ) Notice: Subject to any disclaimer, the term of this patent is extended or adjusted under 35 U.S.C. 154(b) by 0 days.

(21) Appl. No.: 09/481,677

(22) Filed: Jan. 12, 2000

(30) Foreign Application Priority Data

Jan. 12, 1999 (FR) ..... 99 00244

(51) Int. Cl.[7] ..... B65D 39/00

(52) U.S. Cl. ..... 220/849; 220/378; 264/260; 264/267

(58) Field of Search ..... 220/849, 4.24, 220/378; 264/260, 267

(56) References Cited

U.S. PATENT DOCUMENTS

| | | | | |
|---|---|---|---|---|
| 2,565,939 | * | 8/1951 | Wriston | 220/849 X |
| 2,737,189 | * | 3/1956 | Morningstar et al. | 220/849 X |
| 3,052,371 | * | 9/1962 | Van Bemmelen . | |
| 4,311,317 | * | 1/1982 | Bartels | 277/212 C |
| 4,917,131 | * | 4/1990 | Contreras, Sr. | 220/849 X |
| 5,445,293 | * | 8/1995 | Schutz | 220/378 X |
| 5,868,273 | * | 2/1999 | Daenen | 220/378 X |

FOREIGN PATENT DOCUMENTS

| | | |
|---|---|---|
| 0552086A1 | 7/1993 | (EP) . |
| 0861613A2 | 9/1998 | (EP) . |
| 1120663 | 7/1956 | (FR) . |
| 2696156A1 | 4/1994 | (FR) . |
| 2759351A1 | 8/1998 | (FR) . |
| 2763812A1 | 12/1998 | (FR) . |
| 2770105A1 | 4/1999 | (FR) . |

* cited by examiner

*Primary Examiner*—Steven Pollard
(74) *Attorney, Agent, or Firm*—Young & Thompson

(57) ABSTRACT

The present invention relates to a process for the production of a case (1) with a sealed closure, in particular for cosmetic products, of the type comprising a bottom (2) provided with a compartment (5) enclosing the product and on which is articulated a cover (3), the cover (3) and the bottom (2) being provided with complementary closure means and the cover (3) or the bottom (2) having a sealing joint (7), in which process the bottom (2) and the cover (3) are obtained by molding.

The invention consists in that the sealing joint (7) is formed in the bottom (2) or the cover (3) of the case (1) by molding by co-injection of said sealing joint (7) and the bottom (2) or the cover (3).

14 Claims, 3 Drawing Sheets

CASE WITH SEALED CLOSURE

The present invention relates to a case with a sealed closure for cosmetic products, of the type comprising a bottom on which is articulated a cover, the cover and the bottom being provided with complementary closure means.

Cosmetic products often contain volatile compounds and/or compounds sensitive to air. Also, to preserve the qualities of the product contained in the case, there have been provided sealed closures for these. The sealing of the cases is generally carried out with the help of a sealing joint connected to the bottom or the cover of the case and which, during closing, comes into sealed bearing on the cover or on the bottom, respectively, so as to prevent the evaporation of the volatile products or to prevent too great contact with the air.

The sealing joint is generally constituted of a flexible material and is emplaced on the cover or the bottom so as to extend slightly in projection relative to the plane of the cover or the bottom such that it deforms by compression respectively against the bottom or the cover of the case during closing of the case thereby creating the seal.

The sealing joint is connected to the cover or to the bottom of the case either by cementing or by forcible irreversible engagement in a compartment provided for this purpose on the case and a sealing joint is generally present in the form of either a flat joint or of a joint with a circular transverse cross-section bearing sealingly on the flat surface at the periphery of the compartment to be isolated and located facing said joint. Because of the speed of production and to keep the cost economically advantageous, the shape of said joint must remain as simple as possible to permit simple emplacement.

Thus, if the joint had a more complicated shape, for example at the level of those portions coming into a sealed bearing against the case, it would be necessary to cause the production of the case to be able to orient the joint to emplace it correctly.

Such an indexing operation of the joint would be costly in time and in material.

So as to overcome this drawback, the present invention has for its object to provide a case in which there is obtained a sealed joint that can have a complicated shape and this whilst offering simple fabrication of the case which is not too difficult to practice and advantageous from an economic standpoint.

To this end, the invention has for its object a process for the production of a case with a sealed closure, in particular for cosmetic products, of the type comprising a bottom provided with a compartment enclosing the product and on which is articulated a cover, the cover and the bottom being provided with complementary closure means and the cover or the bottom having a sealing joint, in which process the bottom and the cover are obtained by molding, characterized in that the sealing joint is arranged in the bottom or the cover of the case by conjoint molding of said sealing joint and of the bottom or the cover.

Thus, in a preferred manner, the production of the sealing joint and its emplacement in the case are carried out in the course of a single operation. As a result, it is possible to give the joint a particular shape so as to promote sealing of the case and this with a simple production process.

As a result, the shape of the sealing joint can easily vary and have a simple or complicated shape as desired, as a function of the mold in which the molding by co-injection is carried out. The process of production according to the invention therefore permits easily defining the shape of the sealing joint.

The invention therefore also has for its object a case with a sealed closure, in particular for cosmetic products, of the type comprising a bottom provided with a compartment enclosing the product and on which is articulated a cover, the cover and the bottom being provided with complementary closure means, the cover or the bottom comprising a sealing joint, characterized in that the sealing joint is arranged in the bottom or the cover by molding by co-injection of the sealing joint and said bottom or said cover.

In a particularly preferred manner, the sealing joint is thus produced in one piece with the bottom or the cover and can have a complex shape determined by the mold in which the bottom or the cover are co-injected with the sealing joint.

Thus, the joint of a case according to the invention can have at least one flexible lip projecting so as to define a sealing zone at the periphery of the compartment of the case enclosing the product in the closed position of the case.

This flexible lip, continuous along the joint and projecting radially or axially, during the closing of the case, can preferably come into sealed bearing contact against the opposite surface of the case and thereby delimit at least one seal at the periphery.

Preferably, this lip can be subjected in the closed position of the case to an axial compression, which is to say in the plane of the joint, the end of the lip defining a flat sealing zone or else a radial compression, said lip extending along and in sealed bearing contact against one surface of the case according to a particular shape of the latter.

Thus, the bottom of the case can comprise a projecting wall delimiting the compartment and the joint is provided in the cover such that the flexible lip projecting axially from the joint into the cover can define a sealing zone along the external surface of the wall in the closed position of the case, the internal surface of the lip being in sealed bearing contact along said wall.

Preferably, the axially projecting lip also defines a shoulder in the joint such that said shoulder defines a sealing zone on the upper edge of the wall.

The joint can also be arranged such that the axially or radially projecting lip can define a sealing zone on the upper edge of the wall.

According to another embodiment, the joint has at least two projecting flexible lips each defining a sealing zone with the opposite surface of the case at the periphery of the compartment of the bottom in the closed position of the case.

Preferably, these lips project axially, parallel to each other and are preferably of the same size. The end of said lips is in sealed bearing against the joint plane in the closed position of the case.

As a modification, when the bottom of the case has a wall projecting from said base and delimiting the compartment whilst the cover carries the sealing joint, the at least two flexible projecting lips define for one, a sealing zone on the upper edge of the wall delimiting the compartment, and for the other, a sealing zone along the external surface of the wall.

These two lips can extend in axial projection substantially parallel to each other, one of smaller size defining the sealing zone toward the upper edge of the wall whilst the other of larger size defines the sealing zone along the external surface of the wall.

The small lip extends farthest into the cover whilst the larger lip extends about said smaller lip.

As a modification, the sealing joint provided in the cover can have two flexible lips of which one projects substantially radially toward the center of the cover, preferably spaced from said cover, defining a sealing zone on the upper edge of the wall delimiting the compartment in the bottom of the case, whilst the other flexible lip projects axially, defining a sealing zone along the external surface of the wall, said lips defining themselves at least one right angle and preferably an obtuse angle.

A case obtained by the process according to the invention permits having a sealing joint defining at least two sealing zones as has been seen in the embodiments described above. Thus, during the time the case is used, it undergoes a modification of the flexibility of the sealing joint, for example because of purely mechanical reasons or because of certain compounds constituting the product enclosed in the case, such compounds being thus able to modify the properties of said flexible material, the seal is still maintained.

Thus, in a preferred manner, the joint of the case according to the invention can have a complex shape such that the joint defines at least two sealing zones in the case, separate from each other such that, if one of the sealing zones is no longer perfectly sealed, for example because of an alteration in the elastic properties of the material, the other sealing joint overcomes the deficiencies of the first. As a result, the sealed closing of the case is always maintained. Thus, the sealing lip of the sealing joint which is the more in contact with the product contained in the case can undergo modifications of its characteristics, for example a loss of flexibility, and the second lip protected from the product by the first lip, maintains these properties and hence maintains the seal within the case.

Preferably, an axially projecting lip defining a sealing zone along the external surface of a projecting wall in the bottom, has its internal surface in bearing contact against the external surface of the wall of the bottom, inclined from the center of the case toward the exterior. This inclination of the lip permits a better engagement of the lip along the wall, the base of the lip coming into abutment along and against the wall. Similarly, this inclination of the lip can be provided, in correspondence with an inclination of the upper portion of the external surface of the wall delimiting the compartment in the bottom.

The flexibility of the lips permits, during closing the case, ensuring a perfectly sealed contact between them and the bottom, the lips being slightly deformed.

The invention will now be described in greater detail with reference to the drawings, in which.

Figure 1:
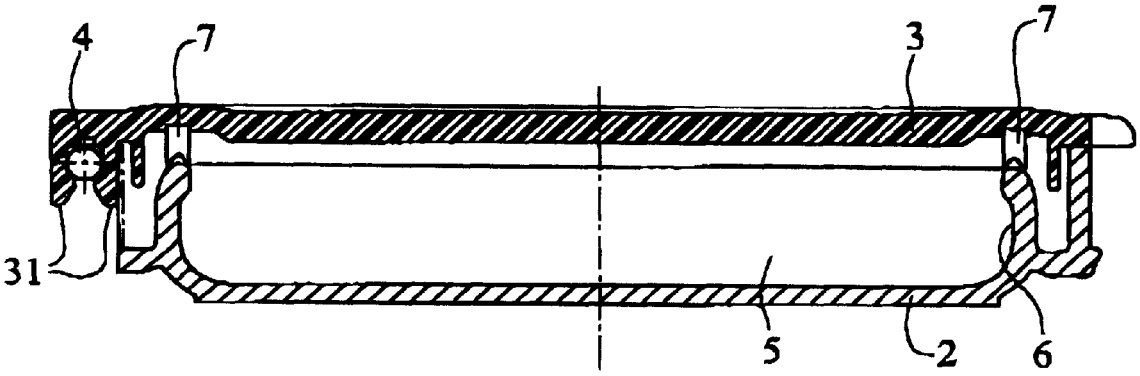
FIG. 1 is a cross-sectional view of a case according to a first embodiment of the invention.
Figure 2:
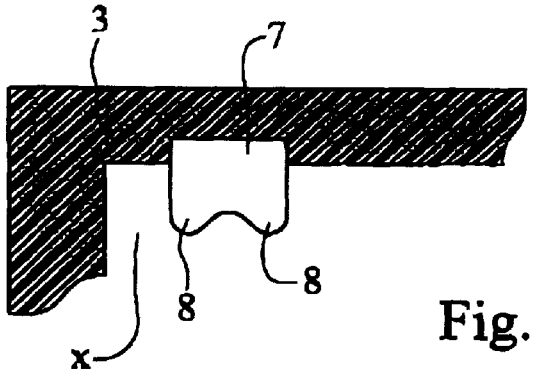
FIG. 2 is a cross-sectional view of a detail of the cover of the case according to FIG. 1.

The case 1 with sealed closure according to the invention comprises a bottom 2 and a cover 3, generally articulated on the bottom 2. The bottom 2 comprises a hinge axle 4 on which is pivotally mounted the cover 3, the latter having along its rear edge 2 projecting tongues 31 forming a gripper clicking over said articulation axle 4.

Preferably, the base 2 and the cover 3 have respectively complementary locking means permitting closing the case 1.

The bottom 2 comprises a compartment 5 in which is emplaced a cosmetic product either directly or by means of a cup. This compartment 5 is in this case defined by a wall 6 extending projectingly from the bottom 2.

The cover 3 has on its internal surface, facing the bottom 2, a sealing joint 7 defining with the bottom 2 two sealing zones at the periphery of the compartment 5 in the closed position of the case 1.

The joint 7 has two flexible axially projecting lips 8 parallel to each other and preferably of the same size. When the case 1 is in the closed position, the lips 8 of the sealing joint 7 bear sealingly against the bottom 2 at the periphery of the compartment 5, and more precisely, the lips 8 are in sealing flat bearing against the upper edge of the wall 6 (FIG. 1), the compression of the lips taking place in the joint plane of the case.

There are thus created two sealing zones extending parallel to each other at the periphery of the compartment 5.

Figure 3:
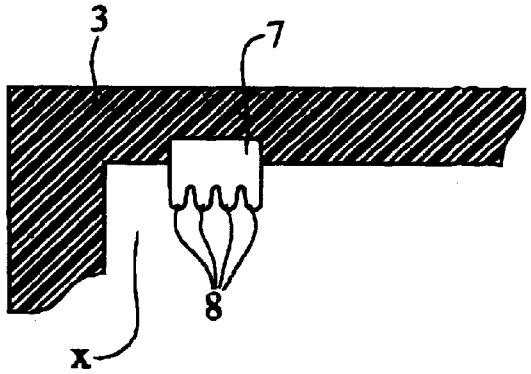
FIG. 3 is a modified embodiment of FIG. 2.

As can be seen in FIG. 3, the joint 7 can comprise three, four, five flexible lips 8, etc., each defining a flat sealing zone with the bottom in the closed position of the case 1.

Figure 4:
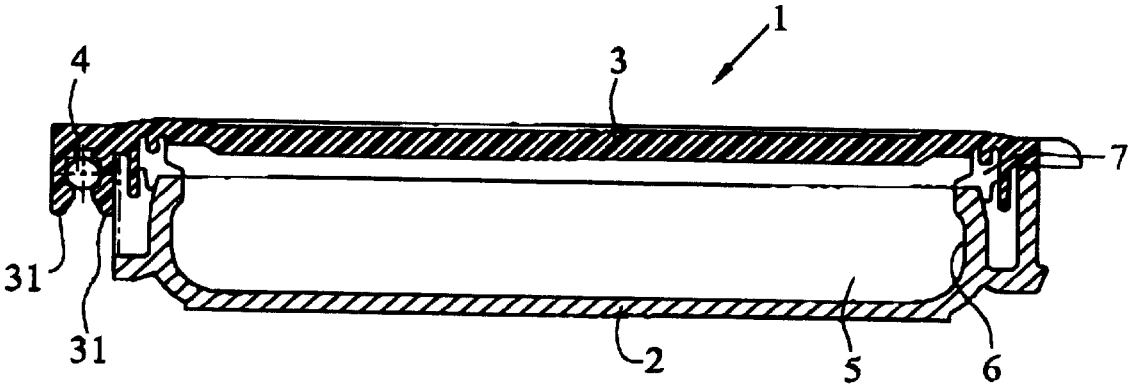
FIG. 4 is a cross-sectional view of a case according to a second embodiment of the invention.

In FIG. 4 is shown a second embodiment of the joint 7 which has two projecting flexible lips 9, 10 defining for one (9) a sealing region on the upper edge of the wall 6 delimiting the compartment 5 in the bottom, and for the other (10) a sealing zone along the external surface of the wall 6, the lip 10 having its internal surface slightly inclined from the center of the cover toward the outside, such that the lip rests against the wall 6 in a sealing manner, the innermost portion of the incline surface being compressed against the wall 6. This incline surface of the lip defines a so-called "conical" sealing surface of the joint 7.

The case 1 is constituted substantially identically to that described in FIG. 1 and the same elements are thus represented with the same reference numerals.

Figure 5:
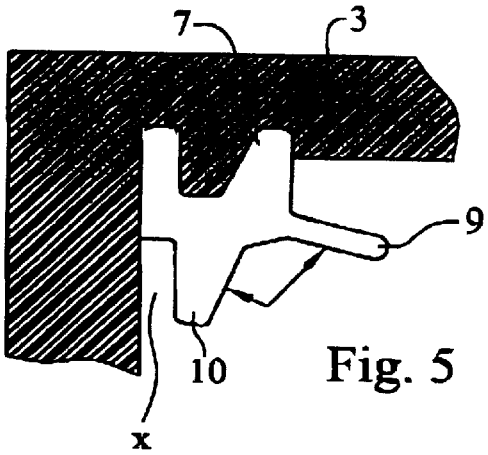
FIG. 5 is a cross-sectional view of a detail of the cover of the case of FIG. 4.

The cover 3 thus has a joint 7 provided with two flexible lips of which one (9) projects substantially radially toward the center of the cover 3, but preferably moving farther away from said cover 3, whilst the other (10) extends substantially axially, the lips 9, 10 defining between them at least one right angle and preferably an obtuse angle $\alpha$ as is visible in FIG. 5.

Thus, when the cover 3 is folded down onto the bottom 2 in the closed position of the case 1, the lip 9, projecting radially toward the interior, comes into flat bearing against the upper edge of the wall 6 delimiting the compartment 5 whilst the axially projecting lip 10 extends substantially along the external surface of the wall 6, the interval between the two lips 9, 10 being if desired in bearing relation against the edge of the wall 6.

Figure 6:
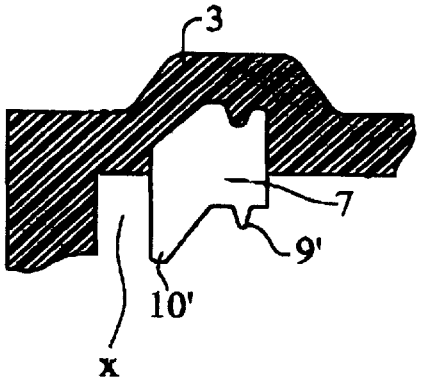
FIG. 6 is a cross-sectional view of a modification of FIG. 5.

In FIG. 6, the sealing joint 7 has two lips 9', 10' both extending substantially axially, the one (9') of small size bearing sealingly on the upper edge of the wall 6 whilst the other (10') is in sealing bearing along said wall 6.

Figure 7:
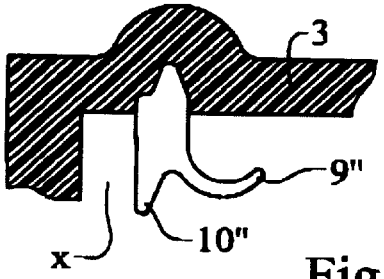
FIG. 7 is a cross-sectional view of a modification of FIG. 5.

In FIG. 7 is shown a modified embodiment of FIG. 5, in which the lip 9" in sealed bearing against the upper edge of the wall 6 extends substantially radially inwardly and has a transverse cross-section curved back toward the cover 3. This curved-back shape of the lip 9" permits, during closing the case, good sealed contact with the upper edge of wall 6.

Figure 8:
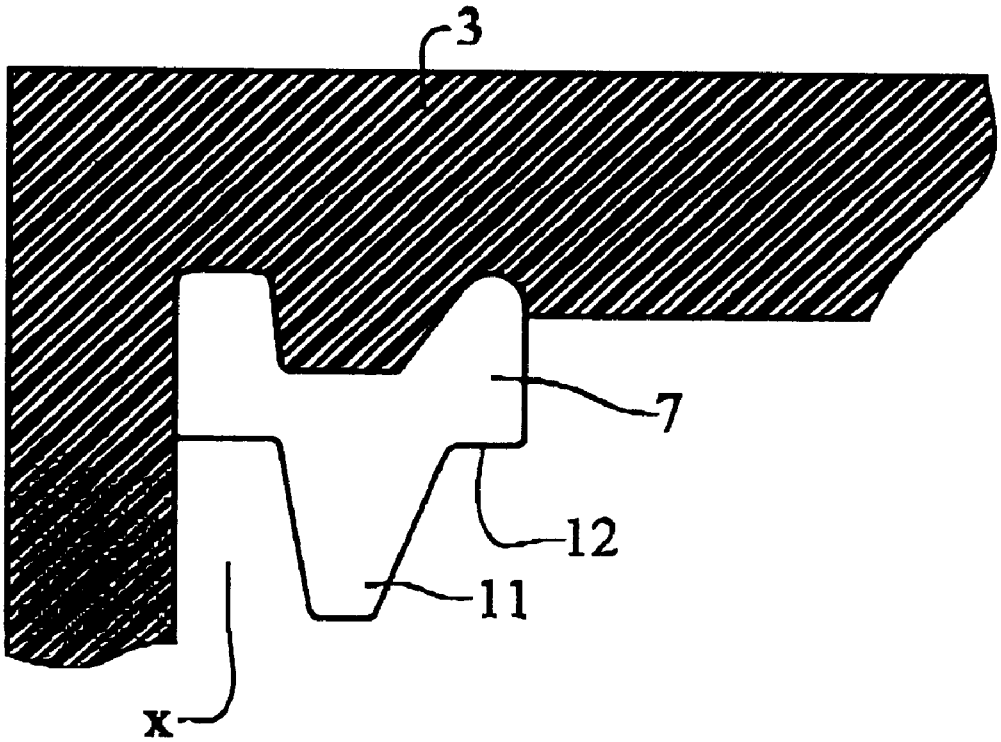
FIG. 8 is a cross-sectional view of the case according to a third embodiment.

In FIG. 8, it can be seen that the sealing joint 7 can comprise an axially projecting sealing lip 11 defining a sealing zone along the wall 6, the internal surface of the lip 11 being inclined (a conical sealing surface). This lip 11 defines with the joint a shoulder 12 and when the case 1 is in the closed position, the lip extends sealingly along the wall 6 whilst the shoulder 12 rests on the upper edge of said wall 6.

Preferably, the bottom 2 and the cover 3 are made by molding from a synthetic material such as polypropylene and the sealing joint 7 is constituted of a flexible and elastically deformable material such as a thermoplastic rubber.

Preferably, in line with each axially projecting lip, for example the lips 10, 10', 10", 8, 11, there is left a void x between the lips 8 or between the sealing joint 7 and the case, so as to promote the expansion of the sealing joint 7 and thereby to facilitate its adaptation to dimensional variations of the case 1. Thus, during its sealed bearing against the wall 6, the lip 10 can be pressed substantially into this recess x.

No matter what embodiment is selected for the case 1 according to the invention, the joint 7 is molded by co-injection with the cover or the bottom obtained from synthetic material such as polypropylene, either by rotary molding or by displacement of a core.

What is claimed is:

1. Process for the production of a case (1) with a sealed closure, in particular for cosmetic products, of the type comprising a bottom (2) provided with a compartment (5) enclosing the product and on which is articulated a cover (3), the cover (3) and the bottom (2) being provided with complementary closure means and the cover (3) or the bottom (2) having a sealing joint (7), in which process the bottom (2) and the cover (3) are obtained by molding, characterized in that the sealing joint (7) is formed in the bottom (2) or the cover (3) of the case (1) by molding by co-injection of said sealing joint (7) and the bottom (2) or cover (3).

2. Process according to claim 1, characterized in that the joint (7) is molded by co-injection with the cover (3) or the bottom (2) either in a rotary mold or by displacement of core.

3. A case (1) with a sealed closure, in particular for cosmetic products, of the type comprising a bottom (2) provided with a compartment (5) enclosing the product and on which is articulated a cover (3), the cover (3) and the bottom (2) being provided with complementary closure means, the cover (3) or the bottom (2) comprising a sealing joint (7), characterized in that the sealing joint (7) is provided in the bottom (2) or the cover (3) by molding by co-injection of the sealing joint (7) and said bottom (2) or cover (3).

4. A case (1) according to claim 3, characterized in that the sealing joint (7) has at least one flexible lip (8, 9', 9", 10, 10', 10", 11) projecting so as to define a sealing zone at the periphery of the compartment (5) of the case (1) in the closed position of said case (1).

5. A case (1) according to claim 4, characterized in that, when the bottom (2) of the case (1) comprises a projecting wall (6) delimiting the compartment (5) of the bottom (2), a flexible lip (11) projecting axially from the joint (7) in the cover (3) defines a sealing zone along the external surface of the wall (6).

6. A case (1) according to claim 5, characterized in that the lip (11) defines a shoulder (12) in the joint (7) such that said shoulder (12) defines a sealing zone on the upper edge of the wall (6).

7. A case (1) according to claim 4, characterized in that the sealing joint (7) has at least two projecting flexible lips (8; 9, 10; 9', 10'; 9", 10") each defining a sealing zone with the opposite surface of the case (1) at the periphery of the compartment (5) of the bottom (2) in the closed position of the case (1).

8. A case (1) according to claim 7, characterized in that the lips (8) project axially parallel to each other and preferably are of the same size.

9. A case (1) according to claim 7, characterized in that, when the bottom (2) of the case (1) has a wall (6) projecting from said bottom (2) and, delimiting the compartment (5) for the product, whilst the cover (3) comprises the sealing joint (7), the at least two flexible projecting lips (9, 10, 9', 10', 9", 10") define for one (9, 9', 9") a sealing zone on the upper edge of the wall delimiting the compartment, and for the other (10, 10', 10") a sealing zone along the external surface of the wall.

10. A case (1) according to claim 9, characterized in that the two lips (9', 10') are in axial projection substantially parallel to each other, one (9') of small size defining the sealing zone on the upper edge of the wall (6) whilst the other (10') of larger size defines a sealing zone along the external surface of the wall.

11. A case (1) according to claim 9, characterized in that the two flexible lips (9, 10; 1", 10") are, as to one (9, 9"), projecting substantially radially toward the center of the cover (3), preferably spaced from said cover (3) defining a sealing zone on the upper edge of the wall, and as to the other (10, 10") axially projecting and defining a sealing zone along the external surface of the wall, said lips defining between them at least a right angle and preferably an obtuse angle ($\alpha$).

12. A case (1) according to claim 11, characterized in that the lip (9") extending substantially radially toward the interior has a transverse cross-section that curves back toward the cover (3).

13. A case (1) according to claim 3, characterized in that, in line with each lip (8, 10, 10', 10", 11) that axially projects, there is a recess (x) between the lips of said joint (7) or between the joint (7) and the case (1) so as to permit expansion of the joint (7) thereby to facilitate its adaptation to dimensional variations of the case (1).

14. A case (1) according to one claim 3, characterized in that the sealing joint (7) is constituted of a flexible and elastically deformable material such as a thermoplastic rubber.

* * * * *